US005173169A

United States Patent [19]

Garrison et al.

[11] Patent Number: 5,173,169

[45] Date of Patent: Dec. 22, 1992

[54] ELECTROPLATING METHOD AND APPARATUS

[75] Inventors: Alexander J. Garrison, Selmer; Otto N. Fanini, Adamsville, both of Tenn.

[73] Assignee: Aqua Dynamics Group Corp., Adamsville, Tenn.

[21] Appl. No.: 697,269

[22] Filed: May 8, 1991

[51] Int. Cl.[5] ..... C25D 5/00; C25D 17/00; C25D 21/10

[52] U.S. Cl. ..... 205/91; 204/140; 204/222; 204/273; 204/DIG. 5

[58] Field of Search ..... 204/DIG. 5, 14.1, 222, 204/273, 140; 205/91, 102

[56] References Cited

U.S. PATENT DOCUMENTS

| | | | |
|---|---|---|---|
| 1,773,275 | 8/1930 | Neeley . | |
| 1,965,399 | 7/1934 | Wehe | 204/DIG. 5 X |
| 2,596,743 | 5/1952 | Vermeiren . | |
| 2,702,260 | 2/1955 | Massa | 204/14.1 X |
| 2,744,860 | 5/1956 | Rines | 204/222 X |
| 2,824,830 | 2/1958 | Hausner | 205/102 X |
| 3,480,522 | 11/1969 | Brownlow | 204/273 X |
| 3,511,776 | 5/1970 | Avampato . | |
| 3,625,884 | 12/1971 | Waltrip . | |
| 4,151,051 | 4/1979 | Evans | 204/DIG. 5 X |
| 4,288,323 | 9/1981 | Brigante . | |
| 4,365,975 | 12/1982 | Williams et al. . | |
| 4,367,143 | 1/1983 | Carpenter . | |
| 4,407,719 | 10/1983 | Van Gorp . | |
| 4,545,887 | 10/1985 | Arnesen et al. . | |
| 4,582,629 | 4/1986 | Wolf . | |
| 4,659,479 | 4/1987 | Stickler et al. . | |
| 4,746,425 | 5/1988 | Stickler et al. . | |
| 4,808,306 | 2/1989 | Mitchell et al. . | |
| 4,865,747 | 9/1989 | Larson et al. . | |
| 4,865,748 | 9/1989 | Morse . | |
| 4,888,113 | 12/1989 | Holcomb . | |
| 4,963,268 | 10/1990 | Morse . | |

FOREIGN PATENT DOCUMENTS

| | | |
|---|---|---|
| 463844 | 8/1928 | Fed. Rep. of Germany . |
| 417501 | 9/1934 | United Kingdom . |
| 606154 | 8/1948 | United Kingdom . |

OTHER PUBLICATIONS

Shortley and Williams, Elements Of Physics, Fifth Edition, Electrostatics, Chap. 22, pp. 474 and 489.

"Aquabel"—Brochure.

"The Ion Stick", York Energy—Brochure.

"An Overview Of Pulse Plating", Norman M. Osero, Mar. 1986.

*Primary Examiner*—Donald R. Valentine

*Attorney, Agent, or Firm*—Foley & Lardner

[57] ABSTRACT

The present invention relates to a method of electroplating in which the electroplating bath is treated by the direct injection of electromagnetic radiation. Most preferably, the electromagnetic radiation is within the radio frequency range and is injected through a metal conductor directly in contact with the bath. Such treatment increases the speed of electroplating as well as the quality of the plated product. The invention is applicable to the plating of zinc, chrome, nickel, precious metals and the like.

21 Claims, 4 Drawing Sheets

ELECTROPLATING METHOD AND APPARATUS

BACKGROUND OF THE INVENTION

1. Field of the Invention

The present invention relates generally to the art of electroplating and more specifically to an electroplating method in which the plating bath is treated prior to and/or during the plating process. Still more specifically, the invention relates to electroplating wherein electromagnetic radiation is injected into the plating bath, most preferably in the radio frequency range and with injection occurring through a conductor in direct contact with the plating bath.

2. Description of the Prior Art

Numerous systems have been proposed over the years for treating aqueous solutions to obtain improvements in certain methods or to achieve certain properties for the treated solution. Several examples of the types of treatment include those involving the use of electromagnets, permanent magnets, ultrasound, electrostatic fields and the like. While some within the scientific community are convinced of the effectiveness of such treatment methods, considerable skepticism remains, and the devices which have been marketed have not received a high degree of commercial success. The types of applications with which such treatment methods have been employed are also widely varied. Some will be described below in connection with the description of certain specific prior art, but generally, they have included the treatment of aqueous solutions to prevent scaling in boilers, cooling towers and the like; the treatment of emulsions; the treatment of certain non-aqueous materials such as fuels for increasing the fuel burning efficiency thereof; the treatment of automobile radiator fluid; and other diverse applications.

Several representative samples of such prior art treatment systems will now be disclosed briefly, but particular attention should be direct to the Morse patents, the backgrounds provided therein, and the references cited against same.

One such treatment device, called the Ion Stick, utilizes the application of an electrostatic field, as illustrated in a brochure entitled "The Ion Stick", copies of which are provided with this specification. This device is a non-chemical, non-polluting electrostatic water treater energized by its own power pack. Another electrostatic treatment method and device is disclosed in U.S. Pat. No. 4,545,887 issued Oct. 8, 1985 to Arnesan, et al.

Other devices employ fixed magnets for water treatment. Examples include U.S. Pat. No. 4,808,306, issued Feb. 28, 1989 to Mitchell and entitled "Apparatus for Magnetically Treating Fluids", and U.S. Pat. No. 4,367,143, issued to Carpenter on Jan. 4, 1983 for "Apparatus for Magnetically Treating Liquid Flowing Through a Pipe and Clamping Means Therefor".

A different magnet arrangement for water treatment is disclosed in U.S. Pat. No. 4,888,113, issued to Holcomb on Dec. 19, 1989 for "Magnetic Water Treatment Device". In this patent, Holcomb discusses the use of a plurality of rectangular magnets attached to the exterior of a pipe. The magnets are arranged in pairs adjacent the pipe such that the positive pole of one pair is oriented to one end of the support housing and the negative pole is oriented toward the other end of the housing. Another similarly constructed housing is secured to the opposite side of the pipe, but reversed with respect to magnet polarity. Thus, the positive pole of the first set faces the negative pole of the second set to cause an "attractive" mode of magnetic flux treatment. Applications such as scale prevention, as well as use in washing machines, swimming pools, ice rinks, livestock watering, and coffee brewing are suggested. The patent also suggests that the taste of treated water is superior to that of untreated water. The patent further mentions that the magnetic force fields can be generated through wound iron coils coupled to a DC generator.

The assignee of the present invention is the owner of several patents relating to electro-magnetic water treatment devices, including Stickler et al., U.S. Pat. No. 4,746,425, issued May 24, 1988 for "Cooling System for Magnetic Water Treating Device" and Stickler et al., U.S. Pat. No. 4,659,479, issued Apr. 21, 1987 for "Electromagnetic Water Treating Device". Both use a pipe core of alternating magnetic and non-magnetic sections with an electromagnet surrounding the pipe through which the fluid to be treated passes.

The prior art is replete with devices that employ electromagnetic energy for water treatment. Many such devices employ electromagnetic energy at a fixed frequency. Examples of such fixed frequency devices are U.S Pat. No. 4,407,719, issued Oct. 4, 1983 to Van Gorp and entitled "Magnetic Water Treatment Apparatus and Method of Treating Water"; U.S. Pat. No. 4,288,323, issued Sep. 8, 1981 to Brigante and entitled "Free Flow Non-Corrosive Water Treatment Device"; and U.S. Pat. No. 2,596,743, issued May 13, 1952 to Vermeiren and entitled "Electric Device".

Several other United States patents disclose specific methods and/or devices which employ varied and/or mixed frequency electromagnetic energy. For example, U.S. Pat. No. 3,511,776, issued to Avanpoto, discloses a method of using various wavelengths of electromagnetic energy, mostly within the ultraviolet and x-ray spectra, to cause ionic species within a flowing water system to become more susceptible to attraction by a subsequent magnetic field.

U.S. Pat. No. 3,625,884, issued to Waltrip, discloses a sewage treatment method which employs multiple signal generators to simultaneously provide audio frequency and/or radio frequency energy at a number of different frequencies. The frequency output of each separate signal generator may be selected on the basis of the mineral content of the untreated sewage.

U.S. Pat. No. 4,365,975, issued to Williams et al., discloses a method of recovering alkali metal constituents from coal gasification residues by subjecting the residues to electromagnetic energy in the radio frequency-microwave (0.1 to $10^5$ MHz) range. Such electromagnetic radiation is purported to facilitate extraction of the metal.

Another treatment system is disclosed in a patent owned by the assignee of the present invention, namely Larson et al., U.S. Pat. No. 4,865,747, issued Sep. 12, 1989 for "Electromagnetic Fluid Treating Device and Method". An electromagnetic field having a voltage which operates in the range of 1 KHz to 1,000 MHz is applied to a non-ferromagnetic conduit in which a ferromagnetic core is mounted. The core acts as a sacrificial anode and as a receiving antenna for the radio frequency radiation.

Also designed for use in fighting scale formation, a device known as the "Aquabel" has been sold and purportedly involves an electronic circuit producing electromagnetic signals which are transmitted into water through cables coiled in a spiral shape around the water line. A copy of a brochure relating to this device is included with this specification.

Electromagnetic radiation, in the form of microwave radiation, is discussed as a treatment mechanism for emulsions in U.S. Pat. No. 4,582,629, issued to Wolf on Apr. 15, 1986.

An electromagnetic process for altering the energy content of dipolar substances is disclosed in British Patent 417,501, issued Dec. 28, 1934, to Johnson. According to Johnson, irradiating colloids with electromagnetic energy having a wavelength characteristic of the colloid will alter the mobility and viscosity of the colloid. Also, treatment of organic substances such as milk or meat will prevent aging of the substance. Another use is the treatment of living organic matter, such as bean seeds, to increase their growth.

Other methods and devices which involve the treatment of water using electromagnetic energy having a variable frequency include German Patent 463,844 issued Aug. 6, 1928 to Deutsch and British Patent 606,154, issued Aug. 6, 1948, to Brake.

Yet another type of scale prevention is disclosed in U.S. Pat. No. 1,773,275, issued Aug. 19, 1930 to Neeley, which discloses supplying an electric current to the water by subjecting the water to electromagnetic fields or by having it come into contact with electrically charge surfaces.

Another water treating technique is that disclosed in U.S. Pat. No. 4,865,748, issued Sep. 12, 1989 to D. Morse and entitled "Method and System for Variable Frequency Electromagnetic Water Treatment". In this patent, a conductor in direct contact with a fluid to be treated is coupled to a generator of electromagnetic radiation, preferably in the radio frequency range. According to the patent, the radiation is injected at a frequency which is related to the electromagnetic radiation absorption or emission profile of the particular system being treated. This patent focuses on the use of that device for the elimination and prevention of scale buildup in boiler systems and the like. The Morse patent is also owned by the assignee of the present invention. A continuation-in-part of the aforementioned Morse patent issued as U.S. Pat. No. 4,963,268 on Oct. 16, 1990.

The assignee of the present invention has three pending applications relating to use of devices, generally similar to the devices described in the Morse patents. These include U.S. patent application Ser. No. 07/621,619, filed Dec. 3, 1990 and entitled "Ice Making Water Treatment", U.S. patent Ser. No. 07/531,021, filed May 31, 1990 and entitled "Beverage Brewing System", and U.S. patent Ser. No. 07/564,790, filed Aug. 8, 1990 and entitled "Filtration Cleaning System".

Many electroplating systems are known to the art which involve the deposition onto a substrate of a layer of metal from a plating solution. Some systems use constant injection of electrical energy to cause plating to occur, and pulse plating is also known, wherein the current is interrupted 600 to 10,000 times per second to improve plating performance. See the article "An Overview of Pulse Plating", by Osero, furnished with this specification.

SUMMARY OF THE INVENTION

The present invention features a method for improving the speed and quality of electroplating when compared to conventional processes, especially the ability to coat to a desired thickness in a shorter period of time.

Other features are improve appearance and adherence of the coating to the base metal.

A different feature of the invention appears to be an increased lifetime for the sacrificial anode used in the electroplating apparatus. The invention further features the ability of being readily adapted to existing equipment.

How those other features of the invention are achieved will be described in detail in the following description of the preferred embodiment, taken in conjunction with the drawings. Generally, however, they are accomplished using conventional electroplating equipment with the addition of a device for injecting into the electroplating bath, before and/or during the electroplating process, electromagnetic radiation, preferably within the radio frequency range. The injection system includes a generator of electromagnetic radiation, cable for conducting the radiation from the generator to an injector, and an injector, at least part of which is a conductor in direct contact with the plating bath. Other ways in which the features of the invention are accomplished will become apparent to those skilled in the art after the present specification has been read and understood. Such ways are also deemed to fall within the scope of the present invention, and the invention is not to be limited by the single illustrated embodiment, but it is to be limited by the scope of the claims which follow.

DESCRIPTION OF THE DRAWINGS

In the various drawings, like reference numerals are used to describe like components.

DETAILED DESCRIPTION OF THE PREFERRED EMBODIMENT

Before proceeding to the detailed description of the preferred embodiment, several comments are appropriate with regard to the applicability of the invention. While the invention is shown in the FIGURES to involve the electroplating of zinc onto stainless steel rods, the invention has much wider utility, including the electroplating of numerous other metals onto numerous other substrates. Without intending to limit the scope of the invention, nickel, chrome, gold, copper and silver electroplating processes can benefit by treating of the electroplating bath with direct injection of electromagnetic radiation. Moreover, the use of stainless cylinders as the receiving medium is representative only and is not intended in any way to be limiting.

Figure 2:
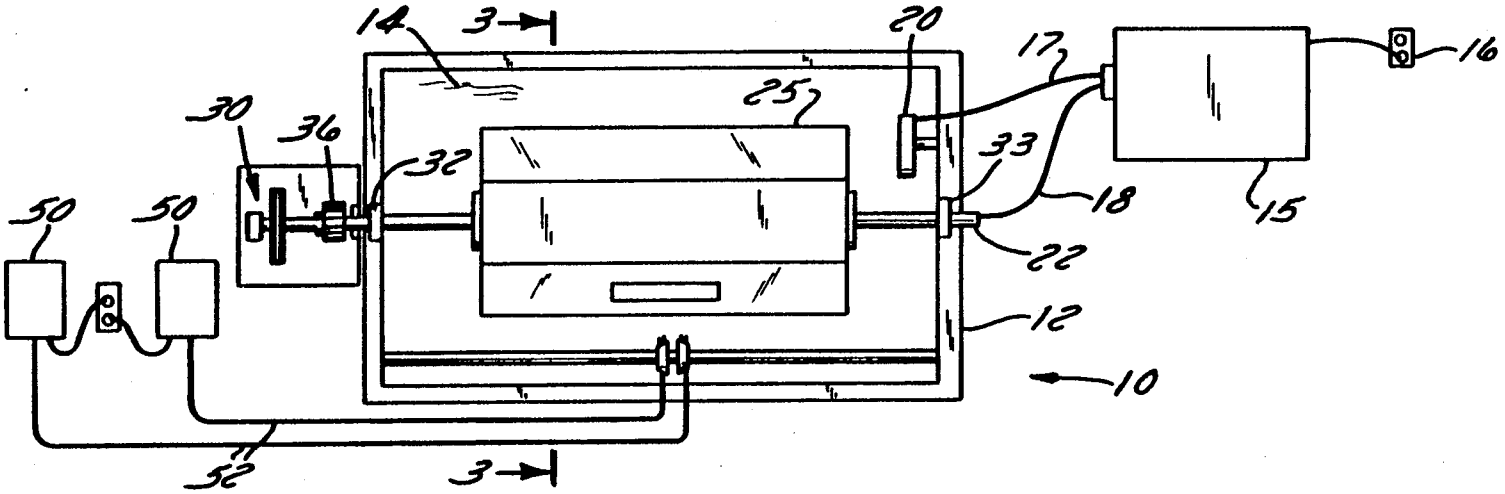
FIG. 2 is a top view of the electroplating system shown in FIG. 1.
Figure 1:
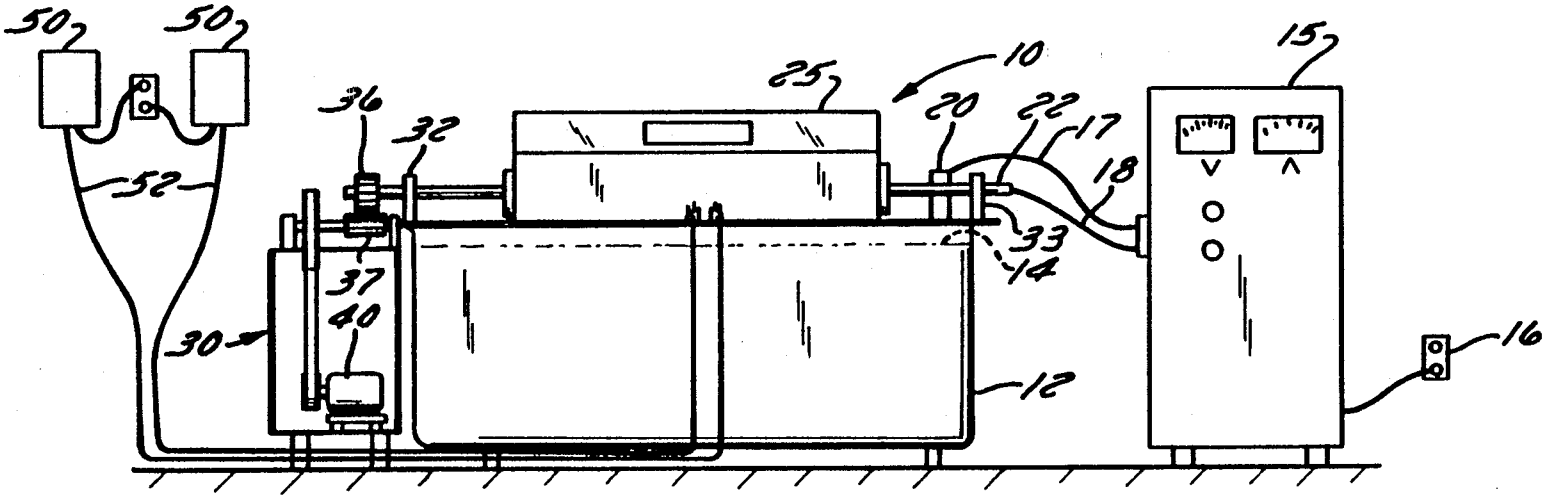
FIG. 1 is a front view of an electroplating apparatus incorporating the electromagnetic radiation injection system of the preferred embodiment of the present invention.
Figure 3:
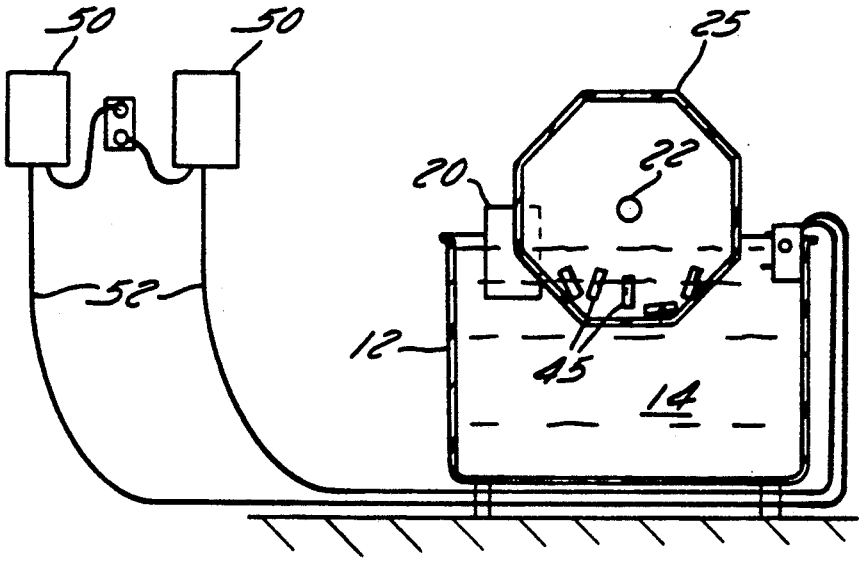
FIG. 3 is a view taken along the line A—A of FIG. 2.

It should also be stated prior to the description of FIGS. 1-3 that the plating equipment is shown in schematic form, and that the direct injection of electromagnetic radiation into the plating bath could be accomplished using numerous other plating systems.

Furthermore, FIGS. 1-3 show two separate injectors for radio frequency energy, but the system does not require the use of two, and one or more could be used depending on the size of the plating tank, the conductivity of the plating solutions and the type of injection system.

Again by way of introduction, it will be helpful at this point to generally describe the effect of the direct injection system, as it is currently understood by the present inventors. This description is without prejudice to other explanations and other mechanisms which might result from the direct injection of electromagnetic radiation into the aqueous solution of plating materials.

Testing conducted by the assignee of the present invention has indicated that such direct injection causes certain fundamental changes in the physical constants of water which have a beneficial effect on electroplating. Clustering properties of the water molecules are believed to be altered. In fact, it has been determined that numerous physical properties associated with water are modified, including such properties as boiling point, freezing point, surface tension, dielectric constant, evaporation rate and the like. The following Table A lists certain characteristics of water which are well documented in recognized sources and the comparable figures determined for a distilled water sample after treatment by a system for directly injecting into the water electromagnetic radiation in the radio frequency range ("Treated Water"). All testing was done using well-known testing procedures and were done at least three times to verify the accuracy of the numbers reported. It should be kept in mind in examining Table A that the tests were performed on divided samples of a particular water solution. The injector system used for the testing will be described in detail in connection with FIGS. 4-5, and the treatment of the water prior to the testing for the results shown in Table A was carried out for 60 minutes using radio frequency injection having a frequency of 43.9 MHz and a current of 425 milliamps at 50 volts p/p.

It is also believed that the frequency of the injected radiation plays a part in the alteration of the physical properties of the solution, and this belief is verified by the fact that the NMR frequency associated with the hydrogen atom is 42.5759 MHz, a number very near that used for testing. It is also believed that other frequencies determined from textbooks for other atomic species present in a solution could be beneficially injected into the solution. Injection of plural frequencies using separate injectors, frequency scanning or multiplexing could result in even greater improvements than those noted below. Current testing would seem to indicate that the water molecules themselves are most strongly influenced.

With regard to the present invention, it is believed that the alteration of the characteristics of surface tension and the ability of ions to move through the aqueous solution resulting from such changes are predominantly responsible for the dramatic results which will be shown in comparative plating data below. Testing conducted on ionic solutions of various commonly encountered compounds, including calcium, magnesium, and silica compounds has produced numerous surprising results which may involve the clustering phenomenon mentioned above or which may involve the effects of the energetics of the ionic or colloidal species present in the solution. For example, significant changes have been noted in the rate of evaporation of such solutions when compared to untreated solutions. Changes in freezing and melting points, changes in ion mobility, changes in dissolved oxygen properties, changes in solubility characteristics, and changes in the antimicrobial properties of the water have all been noted. Moreover, changes in the density of water before and after treatment at various temperatures have also been documented.

TABLE A

| Property | $H_2O$ | Treated Water |
|---|---|---|
| Boiling Point | 100.0° C. | 101.0° C. |
| Melting Point | 0.0° C. | 1.5° C. |
| Temp. Max Density | 3.98° C. | 8.00° C. |
| Refractive Index | 1.336 | 1.349 |
| Dielectric Constant | 81.77 | 85.80 |
| Surface Tension | 73.7 | 62.50 |
| Dipole Moment | 1.76 | 1.77 |
| Specific Heat | 1.00 | 0.98 |
| Magnetic Moment | 0.72 | 0.68 |
| Ionization Potential | $1 \times 10^{-14}$ | $5 \times 10^{-14}$ |

Proceeding now to a description of FIG. 1, a simple electroplating system 10 is shown in front view to include a tank 12 for containing a quantity of electroplating bath 14. Tank 12 is typically made from an electrically non-conductive material. A power supply is shown adjacent tank 12 coupled to an outlet 16. The power supply has positive and negative leads 17 and 18 coupled, respectively, to an anode 20 and to the center shaft 22 of a rotating drum 25. Like the tank, the rotating drum is constructed from electrically non-conductive materials with openings which allow the flow of plating solutions.

At the end of tank 12 opposite power supply 15, a drive system 30 for the barrel is provided. The shaft 22 is mounted in a pair of bearings 32 and 33 and, on its end remote from the power supply 15, a gear 36 is provided. Gear 36 meshes with the drive gear in the drive system 37, the gear in turn being driven by a motor 40.

A top view, as well as a sectional view, of the electroplating device is shown in FIGS. 2 and 3, also illustrate in greater detail several of the standard components used in this illustrated example.

Contained within the rotating barrel are a plurality of articles 45 to be plated. In the illustrated embodiment, the parts are cylinders made from stainless steel SAE 8640 having a diameter of ¼ inch and a length of 4 inches. The aqueous plating solution used in the illustrated example as shown in FIGS. 2 and 3 is made from a standard zinc plating solution of zinc oxide (52 g/L), sodium hydroxide (130 g/L) and sodium cyanide (131 g/L).

Normal deposition time from the plating system shown in FIGS. 1-3 would take approximately 1 hour and 40 minutes, with an average plated thickness of about 16 microns. The power supply was used to supply a constant voltage of 30 volts DC at 250 amps.

Improvement in the electroplating was dramatically noted after including the direct injection into the plating bath of electromagnetic radiation from an injector in direct contact with the bath. In the illustrated example, two radio frequency generators 50 were connected to an AC outlet. Coaxial cables 52 having a length of approximately 23 feet, two inches were coupled thereto. The cables used were standard coaxial cables. The length the cables was selected to be approximately one wave length for the frequency of the electromagnetic energy used. The cables were coupled to injectors having a pair of tips, one in contact with the plating bath and one just above the bath. The placement of one tip above the bath may be desirable in electroplating applications because of the high conductivity of the bath itself, although both tips can be immersed in the bath. In a normal application of the injector, where lower conductivities are encountered, both tips would typically be inserted into the solution. Electromagnetic radiation in the radio frequency range was injected at 42.7 MHz with an amperage of approximately 425 milliamps at 45 volts throughout the electroplating operation.

As previously mentioned, a single injector could be used, as could a larger number than the two injectors shown in the drawing. This choice would be made depending on the size of the electroplating operation.

Figure 4:
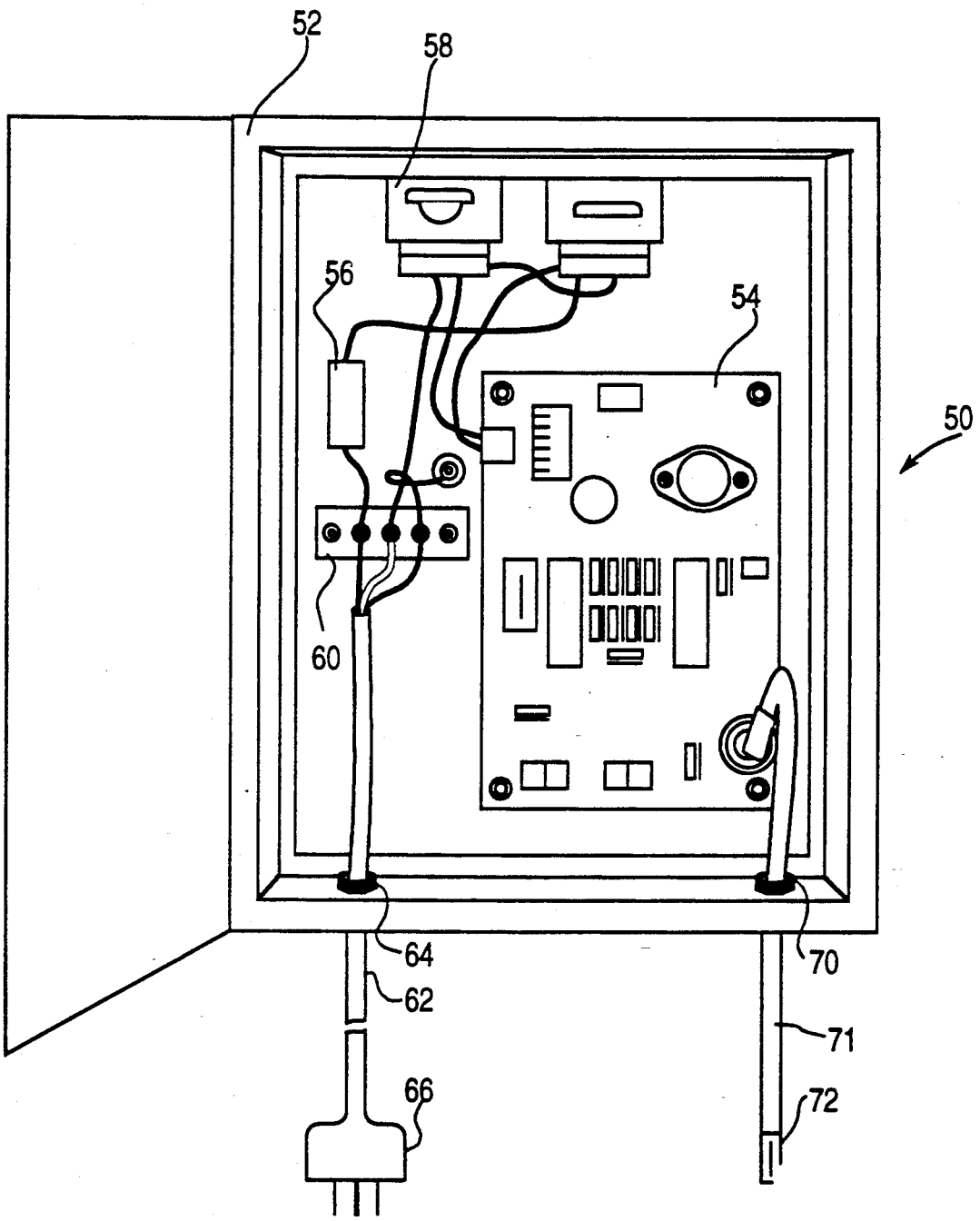
FIG. 4 is a front view of the frequency generator used in the previous FIGURES.

Referring now to FIG. 4, one of radio frequency generators 50 is shown in detail. Radio frequency generator 50 includes a casing 51 comprised of galvanized steel or 11 gauge sheet aluminum. A PC board 54, a fuse 56, a transformer 58, and a terminal block 60 are mounted within casing 51. A power supply cord 62 is connected to terminal block 60 and extends through a hole 64 in one side of case 52. Power cord 62 terminates in a conventional three-prong plug 66 for insertion into a common 120 volt AC outlet. Cable 52 is connected to PC board 54 and passes through an opening 70 in case 51. As stated above, cable 52 is coaxial, and preferably an RG59/U type coaxial cable. Cable 52 terminates in a platinum tipped spark plug 72 whose casing is removed. Other materials may be used to terminate cable 52 such as, stainless steel injector electrodes which are milled to be approximately 1" long and ¼" in diameter. The length of coaxial cable 52 is selected such that it is approximately either one wave length, one quarter wave length, or one-half wave length of the RF signal injected into the bath. For example, for an RF signal having a frequency of 42.7 MHz the cable should preferably have a length of approximately 23 feet to be one wave length long. For other treatment frequencies, the cable length would preferably change to the approximate length dictated by the wave length or a harmonic thereof.

In operation radio frequency generator 50 is connected to an AC 120 volt power source, such as a common household electrical outlet through power cord 62. Power cord 62 terminates at terminal block 60 and the 120 volt AC power is provided to transformer 58 through fuse 56. Fuse 56 is rated at 0.5 amps and protects the circuit on PC board 54 in the event of a short circuit by open circuiting with a momentary short at either the primary or the secondary of transformer 58. Transformer 58 transforms the 120 volt AC, 60 hertz power to 20 volts AC, 60 hertz. Transformer 58 provides power to PC board 54, which generates an RF signal having a typical peak-to-peak voltage of 45 volts. The 45 volt peak-to-peak RF signal is provided on coaxial cable 52 to spark plug 72, where it is injected into the bath.

Figure 5B:
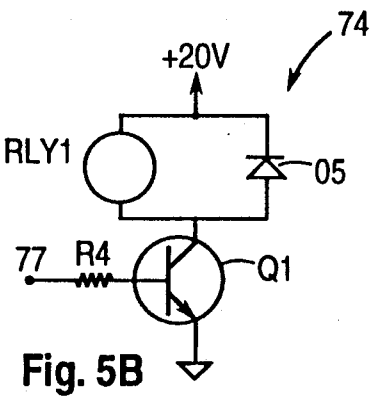
FIG. 5A-5C are a schematic diagram of the PC board of the frequency generator of FIG. 4.
Figure 5A:
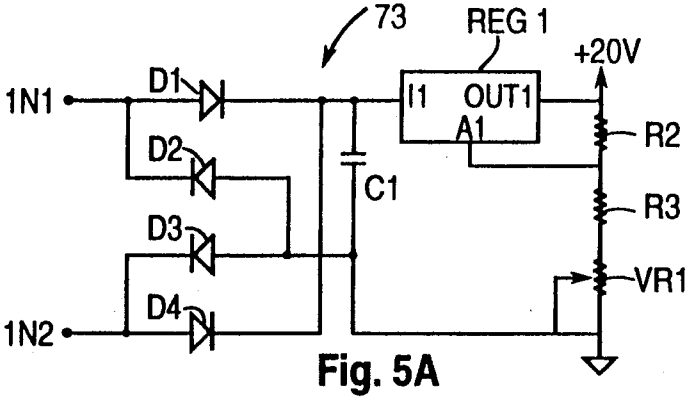
Figure 5C:
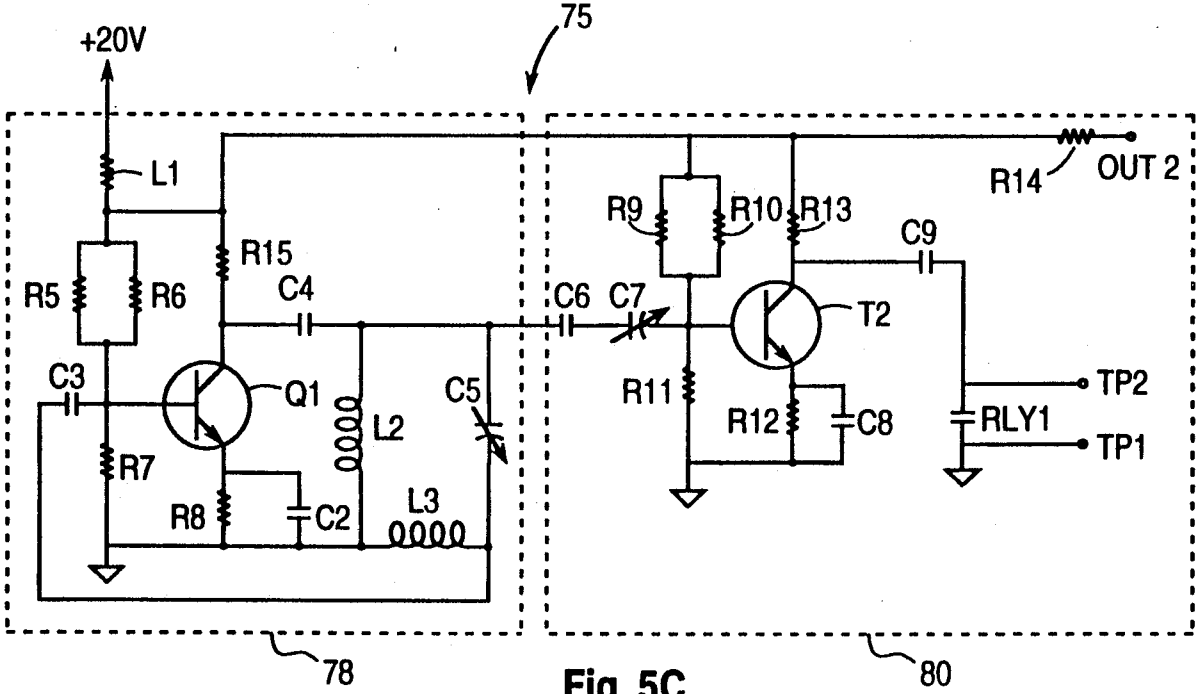

Referring now to FIG. 5, a circuit diagram of the components on PC board 54 is shown. There are three different circuits on PC board 54: a power supply circuit 73, (FIG. 5A) a turn off circuit 74, (FIG. 5B) and an oscillator circuit 75. Power supply circuit 73 provides power to turn off circuit 74 and oscillator circuit 75 (FIG. 5C). Turn off circuit 74 is used to disable the output of oscillator circuit 75 and may be omitted in alternative embodiments. Oscillator circuit 75 generates the RF signal which is injected into the bath. Power supply circuit 73 includes terminals IN1 and IN2, diodes D1–D4, capacitor C1, resistors R2 and R3, variable resistor VR1, and voltage regulator REG1. A 20 volt RMS AC signal is applied by transformer 108 to terminals IN1 and IN2. Diodes D1–D4 rectify the 20 volt RMS AC signal and the AC ripple is filtered by capacitor C9. The rectified and filtered 20 volts DC is provided to input terminal I1 of voltage regulator REG1. The output terminal OUT1 and adjust terminal A1 of voltage regulator REG1 are connected to a voltage divider resistor network comprised of R2, R3 and VR1 to provide +20 volts at terminal OUT1 of voltage regulator REG1. The voltage of OUT1 is adjusted by adjusting the resistance of VR1. The +20 volt supply is then provided to turn off circuit 74 and oscillation circuit 75.

Turn off circuit 74 is comprised of an input 77, a resistor R4, a relay RLY1, a diode D5 and a transistor Q1. Turn off circuit 74 is coupled to power supply circuit 73 and receives the +20 volt power supply. Resistor R4 is applied to the base of Q1 and the emitter of Q1 is connected to ground. The collector of Q1 is connected to the parallel combination of the coil of relay RLY1 and diode D5. The opposite ends of relay RLY1 and diode D5 are connected to the positive +20 volt supply. When a positive voltage, relative to ground, sufficient to turn on transistor Q1, is applied to the base of Q1 through resistor R4 and input 77, transistor Q1 begins conducting and causes relay RLY1 to trip. As will be explained later, this causes the output of oscillator circuit 75 to be grounded, in effect turning off oscillator circuit 75.

Oscillator circuit 75 is coupled to power supply circuit 73 and is powered by the +20 volt power supply. Output OUT2, for lighting an LED, and outputs TP1, TP2 which carry the 45 volt peak-to-peak RF signal are provided. Generally, oscillator 75 includes tank circuit 78 and amplifier circuit 80. Tank circuit 78 provides a RF signal at a frequency of about 42.7 MHz, and an amplitude of about 10 volts peak-to-peak. The amplitude is controlled by the magnitude of the supply signal, and thus selected by adjusting the resistance of VR1, in power supply circuit 73. The RF signal is provided to amplifying circuit 80, where it is amplified to about 45 volts peak-to-peak. Tank circuit 78 includes resistors R5, R6, R7, R8, R9, capacitors C2, C3, and C4, variable capacitor C5, inductors L1, L2 and L3, and a high frequency transistor T1.

Inductor L1 is provided to further filter the AC ripple in the +20 volt supply. Resistors R5, R6 and R7 are provided to DC bias the base of transistor T1, which has resistor R8 and capacitor C2 tied between the emitter and ground. Capacitors C3 and C4, variable capacitor C5, resistor R15 and inductors L2 and L3 complete a tank circuit which oscillates at a frequency selected by adjusting the capacitance of variable capacitor C5. It has been determined that using components having the values listed below provides a tank circuit that operates at a frequency of about 42.7 MHz. Of course, as those skilled in the art will recognize, other component values, as well as different oscillating circuits, may be used to obtain this frequency. If treatment frequencies other than 42.7 MHz are desired, one skilled in this art will recognize that changing the values of the tank circuit components just identified would result in a new output frequency. Moreover, as previously mentioned, different frequencies could be applied in the treating step by using multiple generators, crystal systems, frequency scanning or by multiplexing tank circuit 78.

The output of tank circuit 78 is provided to amplifier circuit 80. Amplifier circuit 80 includes capacitors C6, C8 and C9, variable capacitor C7, resistors R9, R10, R11, R12, R13 and transistors T2 and Q2. The approximately 10 volt peak-to-peak AC signal is provided through capacitor C6 and variable capacitor C7 to the base of transistor T2. The DC bias set for the base of transistor T2 is provided by a voltage divider network comprised of R9, R10 and R11. Variable capacitor C7 couples with tank circuit 54 and is used to fine tune the frequency of its output, in cooperation with variable capacitor C3. Transistor T2 amplifies the RF signal, which is then provided to output TP2 through capacitor C9 Output TP1 is connected to ground so that the 45 volt peak-to-peak AC signal is seen across outputs TP2 and TP1. Relay RLY1 is connected across TP2 and TP1 so that when the coil of RLY1 is set, a short circuit is provided between TP1 and TP2, grounding the output provided by oscillator circuit 80. As described above, the RF signal across TP1 and TP2 is provided to coaxial cable 18 for treating the bath.

The +20 volt power supply is provided to output OUT2 through a resistor R14 for illuminating an external LED. The external LED is illuminated when power is applied to oscillator circuit 75.

Radio frequency generator 140, the generator of the preferred embodiment, thus provides a 45 volt peak-to-peak RF signal having a frequency of about 42.7 MHz for injection into the bath. The device is powered by conventional house current and delivers the signal using coaxial cable 71 terminated with a platinum tipped spark plug 72. For maximum power transfer, certain applications may require impedance matching of the coaxial cable, thus reducing standing waves to the minimum.

| IDENTIFICATION OF CIRCUIT COMPONENTS | |
|---|---|
| L1 | 102 μH |
| L2 | 0.1 μH |
| L3 | 0.1 μH |
| T1 | NTE235 |
| T2 | NTE235 |
| VR1 | 1K Ω |
| R2 | 240 Ω |
| R3 | 3.3K Ω |
| R4 | 1K Ω |
| R5 | 680 Ω |
| R6 | 680 Ω |
| R7 | 47 Ω |
| R8 | 10 Ω |
| R9 | 680 Ω |
| R10 | 680 Ω |
| R11 | 47 Ω |

-continued

| IDENTIFICATION OF CIRCUIT COMPONENTS | |
|---|---|
| R12 | 10 Ω |
| R13 | 51 Ω |
| R14 | 2.2K Ω |
| R15 | 51 Ω |
| C1 | 1,000 uF |
| C2 | .001 nF |
| C3 | 47 pF |
| C4 | 33 pF |
| C5 | 20-100 pF |
| C6 | 100 pF |
| C7 | 20-100 pF |
| C8 | 47 pF |
| C9 | 47 pF |
| D1 | 1N 5401 |
| D2 | 1N 5401 |
| D3 | 1N 5401 |
| D4 | 1N 5401 |
| D5 | 1N 4804 |
| REG1 | LM338 |
| RLY1 | A28-ICH-24DE |
| Q1 | 2N3904 |
| Q2 | 2N3904 |

Numerous enchancements were noted in connection with electroplating carried out when electromagnetic radiation was directly injected into the bath. A reduction in deposition time for a given coating thickness was achieved. Consequently, for a given deposition time, a thicker coating could be achieved under similar conditions. There were smaller thickness variations on a given plated unit and more uniform coverage, both on individual units and across a particular batch. The average grain size on the coating is reduced, thereby decreasing the void spaces in the coating through which corrosive agents would be able to attack the coated part. As a result, a given thickness provides larger corrosion protection. The plating has a denser packing and tighter bonding following the above-described treatment as compared to conventional plating processes. Equivalent corrosion protection can be achieved with thinner coated layers. It was also noted that the leveling of the coating was improved, as well as a better brightness and finish for the part. It is also believed that an increased lifetime for the part is provided according to preliminary examinations of the testing results. Further, increased adherence is achieved due to the tighter bonding of the grains forming the coating.

Table B is a summary of testing results achieved using the electroplating system shown in FIGS. 1-3 for 39 batches of treatment. While some of the assessments are subjective, the thickness and reject rates are quantitative. All testing was done at the same length of electrode position and all using the 30 volt DC, 250 amp procedure described above.

TABLE B

| BATCH # | QED | APPEARANCE | DEPOSITION TIME | THICKNESS MICRONS | BRIGHTNESS | ADHERENCE | REJECT (KILOGRAMS) | PLATING SOLUTION REPLACEMENT |
|---|---|---|---|---|---|---|---|---|
| 1 | OFF | GOOD | 1 H 40' | 15-17 | NORMAL | GOOD | 0.2 | NO |
| 2 | ON | GOOD | 1 H 40' | 18-21 | BETTER | BETTER | 0.1 | NO |
| 3 | OFF | GOOD | 1 H 40' | 14-16 | NORMAL | GOOD | 1.5 | NO |
| 4 | ON | BETTER | 1 H 40' | 15-20 | BETTER | GOOD | 0.1 | NO |
| 5 | OFF | GOOD | 1 H 40' | 15-17 | NORMAL | GOOD | 1.0 | NO |
| 6 | ON | BETTER | 1 H 40' | 18-20 | BETTER | BETTER | 0.1 | NO |
| 7 | OFF | GOOD | 1 H 40' | 14-16 | NORMAL | GOOD | 1.5 | NO |
| 8 | ON | GOOD | 1 H 40' | 18-20 | NORMAL | GOOD | 0.3 | NO |
| 9 | OFF | GOOD | 1 H 40' | 15-17 | NORMAL | GOOD | 0.0 | YES |
| 10 | ON | BETTER | 1 H 40' | 15-21 | BETTER | BETTER | 0.0 | NO |
| 11 | OFF | GOOD | 1 H 40' | 15-17 | NORMAL | GOOD | 0.0 | NO |
| 12 | ON | BETTER | 1 H 40' | 14-18 | BETTER | GOOD | 0.0 | NO |
| 13 | OFF | GOOD | 1 H 40' | 14-16 | NORMAL | GOOD | 0.0 | NO |

TABLE B-continued

| BATCH # | QED | APPEAR-ANCE | DEPOSITION TIME | THICKNESS MICRONS | BRIGHT-NESS | ADHER-ENCE | REJECT (KILOGRAMS) | PLATING SOLUTION REPLACEMENT |
|---|---|---|---|---|---|---|---|---|
| 14 | ON | BETTER | 1 H 40' | 16–20 | BETTER | GOOD | 0.0 | NO |
| 15 | OFF | GOOD | 1 H 40' | 14–16 | NORMAL | GOOD | 0.1 | NO |
| 16 | ON | BETTER | 1 H 40' | 18–20 | BETTER | GOOD | 0.0 | NO |
| 17 | OFF | GOOD | 1 H 40' | 14–17 | NORMAL | GOOD | 0.5 | NO |
| 18 | ON | BETTER | 1 H 40' | 16–18 | NORMAL | BETTER | 0.0 | NO |
| 19 | OFF | GOOD | 1 H 40' | 13–15 | NORMAL | GOOD | 0.0 | NO |
| 20 | ON | BETTER | 1 H 40' | 15–19 | NORMAL | GOOD | 0.2 | NO |
| 21 | OFF | GOOD | 1 H 40' | 13–15 | NORMAL | GOOD | 1.0 | NO |
| 22 | ON | BETTER | 1 H 40' | 16–19 | NORMAL | GOOD | 0.2 | NO |
| 23 | OFF | GOOD | 1 H 40' | 15–17 | LOW | WEAK | 2.0 | NO |
| 24 | ON | GOOD | 1 H 40' | 18–20 | NORMAL | GOOD | 0.5 | NO |
| 25 | OFF | GOOD | 1 H 40' | 15–17 | LOW | WEAK | 3.5 | NO |
| 26 | ON | GOOD | 1 H 40' | 16–21 | LOW | WEAK | 0.8 | NO |
| 27 | OFF | GOOD | 1 H 40' | 15–17 | NORMAL | GOOD | 0.0 | YES |
| 28 | ON | BETTER | 1 H 40' | 19–24 | BETTER | GOOD | 0.0 | NO |
| 29 | OFF | GOOD | 1 H 40' | 16–18 | NORMAL | GOOD | 0.0 | NO |
| 30 | ON | BETTER | 1 H 40' | 18–20 | BETTER | BETTER | 0.0 | NO |
| 31 | OFF | GOOD | 1 H 40' | 15–17 | NORMAL | GOOD | 0.0 | NO |
| 32 | ON | BETTER | 1 H 40' | 16–20 | BETTER | GOOD | 0.0 | NO |
| 33 | OFF | GOOD | 1 H 40' | 15–17 | NORMAL | GOOD | 0.5 | NO |
| 34 | ON | BETTER | 1 H 40' | 18–20 | BETTER | BETTER | 0.0 | NO |
| 35 | OFF | GOOD | 1 H 40' | 16–18 | NORMAL | GOOD | 0.2 | NO |
| 36 | ON | GOOD | 1 H 40' | 18–20 | NORMAL | BETTER | 0.0 | NO |
| 37 | OFF | GOOD | 1 H 40' | 15–17 | NORMAL | GOOD | 1.5 | NO |
| 38 | ON | GOOD | 1 H 40' | 16–18 | NORMAL | GOOD | 0.0 | NO |
| 39 | OFF | GOOD | 1 H 40' | 15–17 | NORMAL | GOOD | 1.5 | NO |

While the invention has been described in connection with a particular preferred embodiment, it is not to be limited thereby, but is to be limited solely by the scope of the claims which follow.

What is claimed is:

1. A method of electroplating comprising the steps of:

providing an aqueous electroplating bath containing metal ions;

providing an anode for the introduction of current for electroplating;

providing a cathode for the introduction of current for electroplating;

providing articles to be electroplated and arranged to contact the cathode at least periodically;

passing a current between the anode and cathode, the improvement comprising the additional step of treating the bath by injecting into said bath electromagnetic radiation generated by an electromagnetic radiation generator, said injection being through at least one electrical conductor other than said anode and said cathode in direct contact with the bath.

2. The method of claim 1 wherein said treating step occurs during the step of passing the electroplating current through the bath.

3. The method of claim 1 wherein the treating step occurs prior to the step of passing the electroplating current through the bath.

4. The method of claim 1 wherein the electromagnetic radiation is injected into the bath at a frequency in the range of 1 KHz to 1000 MHz.

5. The method of claim 4 wherein the frequency is about 42.7 MHz.

6. The method of claim 1 wherein the electroplating method is employed to deposit onto the articles a metal selected from the group consisting of zinc, chrome, nickel, copper, gold or silver.

7. The method of claim 1 wherein said current is supplied from a DC power supply.

8. The method of claim 1 wherein the treating step occurs prior to and during the time current is passed through said bath.

9. The method of claim 1 wherein at least two generators and two conductors are used for the injection of the electromagnetic radiation.

10. The method of claim 1 wherein the metal ions are zinc ions and the anode is zinc metal.

11. A method of electroplating comprising the steps of:

providing an aqueous electroplating bath containing metal ions;

providing an anode for the introduction of current for electroplating;

providing a cathode for the introduction of current for electroplating;

providing articles to be electroplated and arranged to contact the cathode at least periodically;

passing a current between the anode and cathode, the improvement comprising the additional step of treating the bath by injecting into said bath electromagnetic radiation generated by an electromagnetic radiation generator, said injection being through at least one electrical conductor other than said anode and said cathode in direct contact with the bath; and wherein the articles are enclosed in a rotating barrel made from an electrically insulating material.

12. An electroplating system comprising:

a tank suitable for containing a quantity of an aqueous electroplating bath;

an anode supported in the bath;

a cathode;

a DC power supply coupled to said anode and cathode for supplying electroplating current;

a generator of electromagnetic radiation;

a conductor other than said anode and said cathode disposed within said tank, suitable for making electrical contact with the electroplating bath; and cable means for coupling the generator and conductor.

13. The system of claim 12 wherein the generator is a generator capable of generating electromagnetic radiation within the range of 1 KHz to 1000 MHz.

14. The system of claim 12 wherein the bath contains zinc ions and the anode is zinc metal.

15. A method for reducing the time required to electrodeposit a coating of a metal from an aqueous bath onto articles contained in an electroplating system which comprises the step of directly injecting into the bath through an electrical conductor other than an electroplating electrode electromagnetic radiation 16. The method of claim 15 wherein the electromagnetic radiation has a frequency in the range of 1 KHz to 1000 MHz.

17. A method for improving the adherence of a coating of a metal electrodeposited onto an article from an aqueous plating bath in an electroplating system which comprises the step of directly injecting into the bath through an electrical conductor other than an electroplating electrode electromagnetic radiation in the radio frequency range.

18. The method of claim 17 wherein the electromagnetic radiation has a frequency between 1 KHz to 1000 MHz.

19. A method of electroplating comprising the steps of:

providing an aqueous electroplating bath containing metal ions;

providing an anode for the introduction of current for electroplating;

providing a cathode for the introduction of current for electroplating;

providing articles to be electroplated and arranged to contact the cathode at least periodically;

passing a current between the anode and cathode, the improvement comprising the additional step of treating the bath by injecting into said bath electromagnetic radiation generated by an electromagnetic radiation generator, said injection being through at least one electrical conductor other than said anode and said cathode in direct contact with the bath, and wherein a coaxial cable is employed to couple the generator and the conductor, the length of the cable being selected based on the frequency of the electromagnetic radiation.

20. An electroplating system comprising:

a tank suitable for containing a quantity of an aqueous electroplating bath;

an anode supported in the bath;

a cathode;

a DC power supply coupled to said anode and cathode for supplying electroplating current;

a generator of electromagnetic radiation;

a conductor other said anode and said cathode disposed in said tank, suitable for making electrical contact with the electroplating bath;

cable means for coupling the generator and conductor, and wherein the length of the cable means is selected based on the frequency of the electromagnetic radiation.

21. The apparatus of claim 20 wherein the conductor is a spark plug.

* * * * *